US010940714B2

(12) United States Patent
Meyerhans

(10) Patent No.: US 10,940,714 B2
(45) Date of Patent: Mar. 9, 2021

(54) METHOD AND APPARATUS FOR FORMING ADVERTISING MEDIA COMPILATIONS

(71) Applicant: MUELLER MARTINI HOLDING AG, Hergiswil (CH)

(72) Inventor: Rolf Meyerhans, Reiden (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 531 days.

(21) Appl. No.: 15/641,055

(22) Filed: Jul. 3, 2017

(65) Prior Publication Data

US 2018/0015774 A1 Jan. 18, 2018

(30) Foreign Application Priority Data

Jul. 13, 2016 (CH) ..... 892/16

(51) Int. Cl.
*B65B 35/50* (2006.01)
*B65B 57/10* (2006.01)
(Continued)

(52) U.S. Cl.
CPC ..... *B43M 5/04* (2013.01); *B65B 35/50* (2013.01); *B65B 57/10* (2013.01); *B65B 65/02* (2013.01);
(Continued)

(58) Field of Classification Search
CPC .. B43M 3/04; B43M 5/04; B65B 9/02; B65B 11/50; B65B 11/08; B65B 11/10;
(Continued)

(56) References Cited

U.S. PATENT DOCUMENTS 3,059,391 A 10/1962 Volks et al.
4,071,997 A 2/1978 Gunther, Jr. et al.
(Continued)

FOREIGN PATENT DOCUMENTS

CH 705 359 A1 2/2013
CH 0007315 * 1/2015 ..... B65B 11/18
(Continued)

OTHER PUBLICATIONS

International Search Report for 00892116, dated Oct. 21, 2016, and English translation thereof.

*Primary Examiner* — Hemant Desai
*Assistant Examiner* — Jacob A Smith
(74) *Attorney, Agent, or Firm* — FisherBroyles, LLP; Robert Kinberg

(57) ABSTRACT

A method and an apparatus for forming advertising media compilations respectively consisting of one envelope and a plurality of inserts. Each advertising medium suitable for use as an envelope for an advertising media compilation to be formed is recorded in a computer-aided machine control. For each recorded advertising medium, an offset value is defined which corresponds to the required projecting length, relative to the associated inserts, wherein this offset value is used for forming the required projecting length in case of a changeover from one advertising media compilation to another advertising media compilation having an envelope that differs from the first envelope. The apparatus is respectively provided for this with a separate drive unit, connected to the computer-aided machine control, for at least one of the separating out and feeding elements and to the conveying element.

11 Claims, 8 Drawing Sheets

(51) Int. Cl.

| | |
|---|---|
| ***B65B 65/02*** | (2006.01) |
| ***B43M 5/04*** | (2006.01) |
| ***B65H 39/055*** | (2006.01) |
| ***B65H 45/12*** | (2006.01) |
| ***B65H 39/043*** | (2006.01) |
| ***B65H 43/00*** | (2006.01) |

(52) U.S. Cl.
CPC ..... *B65H 39/043* (2013.01); *B65H 39/055* (2013.01); *B65H 43/00* (2013.01); *B65H 45/12* (2013.01); *B65H 2301/4381* (2013.01); *B65H 2301/4474* (2013.01); *B65H 2404/63* (2013.01); *B65H 2404/693* (2013.01); *B65H 2406/122* (2013.01); *B65H 2511/11* (2013.01); *B65H 2511/22* (2013.01); *B65H 2513/10* (2013.01); *B65H 2513/50* (2013.01)

(58) Field of Classification Search
CPC ..... B65B 25/14; B65B 35/50; B65B 57/10; B65B 65/006; B65H 39/043; B65H 43/00; B65H 45/12; B65H 2301/4474; B65H 2513/50
USPC ..... 53/55, 75, 447, 450, 452, 460, 461, 569, 53/209, 210
See application file for complete search history.

(56) References Cited

U.S. PATENT DOCUMENTS 4,449,351 A * 5/1984 Henderson ..... B65B 11/50 53/266.1
5,155,973 A * 10/1992 Hipko ..... B43M 5/04 53/450
5,164,906 A * 11/1992 Mahmoodi ..... B43M 5/04 271/9.12
5,452,851 A * 9/1995 Albert ..... B42D 5/026 229/301
5,511,357 A * 4/1996 Ricketts ..... B43M 5/042 53/284.3
5,527,418 A * 6/1996 Ginsberg ..... B43M 5/04 156/227
6,106,666 A * 8/2000 Martin ..... B41J 13/106 156/384
6,510,670 B1 * 1/2003 Janhonen ..... B65B 25/14 53/209
6,892,514 B2 * 5/2005 Kragh ..... B65B 11/10 53/209
6,902,518 B2 * 6/2005 Bretl ..... B43M 5/045 156/230
7,694,499 B2 * 4/2010 Ballestrazzi ..... B65B 55/20 53/545
8,544,242 B2 * 10/2013 Munneke ..... B65H 39/043 53/429
2004/0178555 A1 * 9/2004 Mayer ..... B43M 3/045 270/58.03
2005/0174604 A1 * 8/2005 Wiersma ..... G07B 17/00467 358/1.18
2005/0184441 A1 * 8/2005 Munneke ..... B42B 2/00 270/52.14
2005/0235605 A1 * 10/2005 Ballestrazzi ..... B65B 9/067 53/396
2007/0158892 A1 * 7/2007 Fijnvandraat ..... B43M 3/04 270/52.16
2008/0185771 A1 * 8/2008 Lyga ..... B65H 29/58 271/9.01
2010/0122514 A1 * 5/2010 Rozenfeld ..... B43M 3/045 53/460
2010/0202655 A1 * 8/2010 Stegeman ..... B65H 43/00 382/101
2011/0192892 A1 * 8/2011 Van Gorp ..... G06Q 30/0207 229/301
2012/0260605 A1 * 10/2012 Nozawa ..... G03G 15/6594 53/55
2013/0026003 A1 * 1/2013 Meyerhans ..... B65H 39/055 198/347.2
2013/0288871 A1 * 10/2013 Aoto ..... B43M 3/04 493/188
2014/0150378 A1 * 6/2014 Chapman ..... B65B 11/00 53/461
2014/0206520 A1 * 7/2014 Honegger ..... B65H 45/12 493/416
2015/0336698 A1 * 11/2015 Keller ..... B65B 25/14 53/447
2016/0031578 A1 * 2/2016 Fujimoto ..... B65B 63/005 53/64
2016/0207649 A1 * 7/2016 Meyerhans ..... B65B 11/18

FOREIGN PATENT DOCUMENTS

| | | |
|---|---|---|
| CH | 710 435 B1 | 5/2016 |
| EP | 1 550 628 A1 | 7/2005 |
| EP | 3 045 414 A2 | 7/2016 |
| WO | 03/008273 A1 | 1/2003 |

* cited by examiner 11
36
5''
10'
20'
1''
37
40'
24
22
36
1''
29
D'
D
C'
C
B'
B
A'
A
6
d
c
b
a
D''
C''
B''
A''
30
30''
30
30''
30
30

METHOD AND APPARATUS FOR FORMING ADVERTISING MEDIA COMPILATIONS

CROSS-REFERENCE TO RELATED APPLICATION

Priority is claimed herein to Swiss Application No. 00892/16, filed Jul. 13, 2016, the disclosure of which is incorporated herein by reference in its entirety.

BACKGROUND OF THE INVENTION

The invention relates to a method for forming advertising media compilations with respectively one envelope and a plurality of inserts constituting advertising media and a corresponding apparatus for forming advertising media compilations.

Swiss patent document CH 00073/15, with a filing date earlier than the above claimed priority date, discloses such a method and an apparatus for forming advertising media compilations. An advertisement medium is respectively used for the printed products to be combined into advertising media compilations, meaning the envelope as well as the inserts. To simplify the description, the respective advertising media are here either referred to as envelopes or inserts, depending on their use.

Corresponding to this method, the envelope and the inserts are respectively pulled by a separating or feeding element from a respective stack of advertising media in an area of a gathering section and are successively deposited separately, one on top of the other, onto a conveying element moving in a transporting direction. For this, a leading edge of the envelope is respectively deposited in the transporting direction offset to the leading edges of the inserts, to form a projecting length of the envelope, relative to the inserts. The inserts are deposited one on top of the other to form an insert stack, such that the leading edges of the inserts form at least approximately a joint folding edge, wherein the projecting length of the envelope resting flat on the conveying element is folded along the joint folding edge and at least partially around the stack of inserts to form the advertising media compilation which is then transported away for further processing. Thus, the projecting length is not fitted around the trailing region of the inserts for an advertising media compilation to be produced, nor around the side edges. Together with the same and other advertising media compilations, advertising media compilation is then generally distributed to a wholesale distributor and finally to the end customers. Of course, a direct sale to the end customers can also take place.

Depending on the advertising media compilation to be produced, meaning the required envelope for it, a different separating out and feeding element arranged in the region of the gathering section is used for feeding the envelope. In other words, it can happen that the first and additional separating out and feeding elements are not operated, so that the second separating out and feeding element in the transporting direction or a downstream arranged separating out and feeding element, for example, supplies the advertising medium used for the envelope. Supplying the envelope thus always occurs with the first separating out and feeding element that supplies the conveying element.

When changing the production from an advertising media compilation using a first envelope to one using a second envelope that differs from the first envelope, an optional, different separating out and feeding element can separate out an envelope from a corresponding stack of advertising media and transport it to the conveying element, wherein optional, different separating out and feeding elements can also supply inserts from other advertising media stacks.

However, it has proven a disadvantage that for such a change in the production the apparatus must be stopped and a different offset must be input for the leading edge of the new envelope, relative to the leading edges of the corresponding inserts of the second advertising media compilation, via an input means such as a human-machine interface. This has a negative effect of the processing capacity.

SUMMARY OF THE INVENTION

An object of the invention therefore is to provide a method and an apparatus for forming advertising media compilations, composed respectively of an envelope and several inserts, for which the changeover from an advertising media compilation with a first envelope to a following one with an envelope that differs from the first envelope is made possible without having to stop the apparatus and without manual input of the offset for the respectively used additional envelope, thus ensuring a higher processing capacity.

According to a first aspect of the invention, there is provided a method for forming advertising media compilations with respectively one envelope and a plurality of inserts each constituting advertising media which, in one embodiment, comprises: depositing the inserts individually and successively, one above the other, in a region of a gathering section onto a conveying element moving in a conveying direction; depositing a first envelope onto the conveying element with a leading edge of the first envelope in the conveying direction offset to leading edges of inserts associated with the first envelope to form a projecting length of the first envelope relative to the inserts, wherein the inserts are deposited to form an insert stack such that the leading edges of the inserts in the insert stack form at least approximately a joint folding edge; folding the projecting length of the first envelope along the joint folding edge of the inserts and subsequently folding the projecting lengths at least partially around the insert stack to form a first advertising media compilation; transporting the first media compilation away for further processing; subsequently forming a second advertising media compilation with a second envelope and inserts associated with the second envelope, wherein the second envelope differs from the first envelope and the second advertising media compilation is formed essentially in the same way as the first advertising media compilation; recording each envelope used for forming an advertising media compilation in a computer-aided machine control, including recording a defined offset value that corresponds to the projecting length relative to the inserts associated with each envelope to form the projecting length for each envelope; and using the offset value during a changeover from the first advertising media compilation to the subsequent second advertising media compilation having the envelope that differs from the first envelope.

Thus, with the method according to the invention for forming advertising media compilations, the envelopes and advertising media used as inserts are deposited separately and successively, one on top of the other, along a gathering section onto a conveying element moving in transporting direction. In the process, a leading edge of an envelope is deposited offset to the leading edges of the associated inserts, as seen in conveying direction, to form a projecting length of the envelope relative to the inserts. The inserts are deposited one above the other, such that they form a stack of inserts with an approximately joint folding edge, wherein the projecting length of the envelope resting flat on the conveying element is folded along the folding edge and then subsequently folded at least partially around the stack of inserts to form the advertising media compilation, which is then transported away for further processing. A following advertising media compilation with an envelope that differs from the first envelope and associated inserts is formed essentially in the same way as the previous advertising media compilation. Each advertising medium suitable for use as envelope for an advertising media compilation is recorded in a computer-aided machine control and an offset value is defined for each recorded advertising medium, which corresponds to the required projecting length, relative to the associated inserts. This offset value is used for a changeover from one advertising media compilation to a following advertising media compilation to be formed, which uses an envelope that differs from the first envelope to form the required projecting length.

Accordingly, when successively forming several advertising media compilations, a changeover can be made from a first advertising media compilation with a first envelope to a following advertising media compilation with an envelope that differs from the first envelope without having to stop the apparatus and without manual input of the offset value for the respectively required envelope. Corresponding to the following advertising media compilation to be formed, the additional envelope can thus automatically be made available with the required projecting length, relative to the associated inserts, and a higher processing capacity can be achieved.

According to one embodiment of the inventive method, the envelopes and the inserts are respectively separated out of a stack of advertising media, prior to being deposited on the conveying element, and are subsequently transported to the conveying element. In this way, the forming of the advertising media compilations can advantageously be uncoupled from the printing of the envelopes and the inserts. Advertising media produced at different times and on different printing presses and gathered into stacks can thus be used for the envelopes and inserts.

According to a different embodiment of the inventive method, the projecting length of the leading edge of an envelope, relative to the leading edges of the associated inserts, is formed during a separating out from a stack of the respective envelopes or a separating out from stacks of the associated inserts. Two alternatives are thus provided, which can be used according to the corresponding boundary conditions.

According to one alternative embodiment of the inventive method, the projecting length of the edge of an envelope, relative to the leading edges of the associated inserts, is formed while the respective envelope or the associated inserts are transported to the conveying element. Additional options are thus provided which can also be used depending on the specified boundary conditions.

Another alternative embodiment of the inventive method provides that the projecting length of the leading edge of an envelope, relative to the leading edges of the associated inserts, is formed during the transport of the respective envelope or the associated inserts on the conveying element. These alternative solutions provide further options for forming the projecting length, which can also be used depending on the prevailing conditions at the location.

According to a different embodiment of the inventive method, the projecting length of the leading edge of a different envelope, relative to the leading edges of the associated inserts, is formed by accelerating the envelope as compared to the first envelope, or by an earlier movement of the additional envelope during the separating out from the respective stack, or during the transport to the conveying element, or during the transport on the conveying element. Alternatively, this projecting length, as compared to the first envelope, results from a delay or from a later movement of the inserts belonging to the additional envelope during the separating out from the respective stack, or during the transport to the conveying element or during the transport on the conveying element. These alternative solutions create further additional options for forming the projecting length, which can be used depending on the prevailing conditions at the location.

According to another embodiment of the inventive method, the projecting length of an envelope may be transported with the conveying element into the region where a deflection chamber is located where it is admitted by a pneumatic or mechanical deflection element and deflected into the deflection chamber. During the further transport of the envelope in the transporting direction, the projecting length of the envelope is turned over counter to the transporting direction, but only along the folding edge of the insert stack, so that the projecting length comes to rest against the insert stack. While the solution with the pneumatic deflection element does not have a mechanical jamming source and is less subject to malfunctions, the use of a mechanical deflection element may be used for multi-page, rigid envelopes.

According to yet another embodiment of the inventive method, the envelope is deposited on the conveying element prior to depositing the inserts for the advertising media compilation. With this method, the envelope advantageously forms the base for depositing the inserts.

As an alternative, the envelope can also be deposited after the inserts for the advertising media compilation have been deposited on the conveying element. A method of this type is relatively independent of the type and manner of gathering the inserts. For example, these can be gathered ahead of time in a separate process before being deposited jointly on the conveying element and provided with the envelope.

According to another aspect of the invention there is provided an apparatus for forming advertising media compilations composed of respectively one envelope and a plurality of inserts which, in one embodiment, comprises: a gathering section; a conveying element moving in a conveying direction; separating out and feeding elements arranged successively along the gathering section to gather advertising media for use for envelopes or for respectively associated inserts, wherein the separating out and feeding elements are operative for depositing the inserts one above the other to form an insert stack so that leading edges of the inserts in the conveying direction form at least approximately a joint folding edge, the separating out and feeding elements being further operative to deposit an envelope so that a leading edge of the envelope is offset in the conveying direction with respect to the leading edges of the respectively associated inserts to form a projecting length of the envelope relative to the inserts; a deflection chamber arranged downstream of the gathering section and a deflection device for inserting the projecting length of the envelope into the deflection chamber, wherein the conveying element is structured at least in a region of the deflection chamber so that the envelope and the inserts rest flat on the conveying element, and wherein the deflection device is operative to fold the projecting length of the envelope along the folding edge; a folding device arranged downstream of the deflection chamber to further fold the projection length at least partially around the insert stack to form the advertising media compilation; a conveying device arranged downstream of the folding device to carry away the advertising media compilation for further processing; a computer-aided machine control; and at least one individual drive unit for at least one of the separating out and feeding elements and the conveying element, each individual drive unit being connected to the computer-aided machine control.

Thus, the apparatus according to the invention for forming advertising media compilations comprises a gathering section with a conveying element movable in a transporting direction. Several separating out and feeding elements for advertising media usable as envelopes or associated inserts are arranged successively along the gathering section. The separating out and feeding elements are embodied such that the inserts can be deposited one above the other to form a stack, so that the leading edges of the inserts form at least approximately a joint folding edge and the leading edge of the envelope can be deposited in conveying direction offset to the leading edges of the respective inserts, such that a projecting length of the envelope is formed relative to the inserts. A deflection chamber and a deflection device which inserts the projecting length of the envelope into the deflection chamber are arranged downstream of the gathering section. At least in the region of the deflection chamber, the conveying element is embodied such that the envelope as well as the inserts rest flat on the conveying element. The deflection device is operative to fold the projecting length of the envelope along the folding edge. Downstream of the deflection chamber, a folding device is arranged to further fold the projecting length at least partially around the insert stack to form the advertising media compilation, which is then transported away by a conveying device for further processing. A computer-aided machine control and respectively at least one thereto connected individual drive unit are provided for the separating out and feeding elements and/or for the conveying element.

In the same way as for the corresponding method, the apparatus permits the changeover from an advertising media compilation using a first envelope to one that uses a different, second envelope without stopping of the apparatus and without manual input of the offset for the respectively needed envelope. Owing to the arrangement of the individual drive units, the projecting length of the leading edge of a different envelope, relative to the leading edges of the associated inserts, can be formed during the separating out of the respective envelope from the stack, or the separating out of the individual inserts from the stacks, or alternatively also automatically while positioned on the conveying element. A higher capacity can thus be achieved.

According to one embodiment of the inventive apparatus, the separating out and feeding elements are respectively provided with a device for accommodating a stack of advertising media that can be used as envelopes or inserts. Alternatively, a device of this type is arranged upstream of the separating out and feeding elements. By using a corresponding device, forming the advertising media compilations can be uncoupled from the printing of the envelopes and inserts. Stacked envelopes and inserts can thus be used which are produced at different points in time and on different printing presses.

According to a different embodiment of the inventive apparatus, respectively one guide member is positioned between the separating out and feeding elements and the conveying element. Each guide member is drive-connected to the individual drive unit of the respective separating out and feeding element or is provided with a separate individual drive unit that is connected to the machine control. With this embodiment, the projecting length can be formed with the guide members, so that forming the projecting length during the separating out operation can be dispensed with.

According to yet another embodiment of the inventive apparatus, the conveying element is provided with several successively arranged conveying sections, and each conveying section comprises an individual drive unit that is connected to the machine control. With this embodiment, the projecting length can be formed advantageously on the conveying sections of the conveying element and need not be formed during the separating out or conveying with the guide members.

In one embodiment, the deflection device includes a pneumatic or a mechanical deflection element. Whereas a pneumatic deflection element does not cause any jams and is thus more tolerant to defects, a mechanical deflection element is may be used for multi-page, rigid envelopes.

According to a further embodiment of the inventive apparatus, a separating out and feeding element for an envelope is first arranged along the gathering section and separating out and feeding elements for inserts are arranged in the transporting direction downstream. If the envelope is supplied first and then the inserts, based on this embodiment of the gathering section, the latter can be deposited on the envelope.

A different embodiment of the inventive apparatus provides that the separating out and feeding elements for advertising media used for the inserts are first arranged along the gathering section and are followed by a separating out and feeding element for an advertising medium usable as envelope. An alternative technical solution is thus offered which can be advantageous technically and/or economically, depending on the specific requirements of the producer of the advertising media compilation.

DETAILED DESCRIPTION

Figure 1:
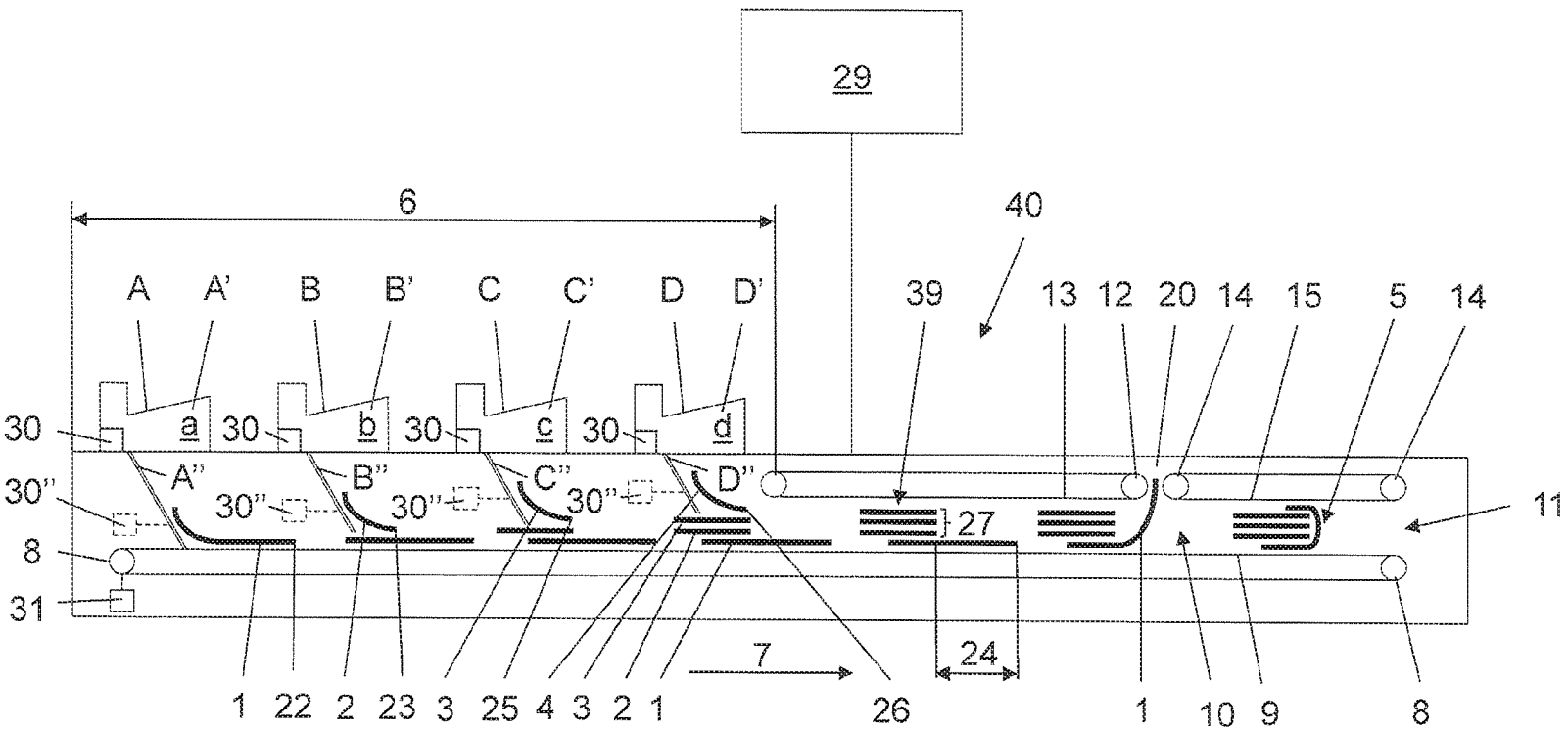
FIG. 1 shows a schematic side view of an apparatus according to a first embodiment of the invention.

Referring to FIG. 1, an apparatus 40 for combining an envelope 1 with several advertising media embodied as inserts 2, 3, 4 to form an advertising media compilation 5. Apparatus 40 comprises a gathering section 6, with separating out and feeding elements A, B, C, D arranged along the gathering section, above a conveying element 9, embodied as a conveying element guided in a transporting direction 7 around deflection rolls 8. Downstream of the gathering section 6, a folding device 10 is arranged for the envelope 1 of the advertising media compilation 5 and even further downstream, a conveying away device 11 for the advertising media compilation 5.

The separating out and feeding elements A, B, C, D include respectively one device A', B', C', and D', for example embodied as a stacking magazine, for respectively accommodating a stack a, b, c, d of advertising media that can be used as the envelope 1 or as the inserts 2, 3, 4. Alternatively, a device A', B', C' and D' (not shown herein) can be arranged upstream of the separating out and feeding elements A, B, C, D.

The apparatus 40 also comprises a computer-aided machine control 29 and, connected thereto, an individual drive unit 30 for each of the separating out and feeding elements A, B, C, D. A separate drive unit 31 for the conveying element 9 is also provided alternatively or additionally.

Respectively one guide member A", B", C", D" for supplying the advertising media to the conveying element 9 is arranged between the separating out and feeding elements A, B, C, D and the conveying element 9. Each guide member A", B", C", D" is drive-connected either to the individual drive unit 30 of the respective separating out and feeding element A, B, C, D or comprises a separate individual drive 30" (shown with dashed lines) that is connected to the machine control 29. Of course, an apparatus embodied without a guide member A", B", C" D" can also be used, for which the advertising media are moved by the separating out and feeding elements A, B, C, D directly to the conveying element 9.

Figure 2:
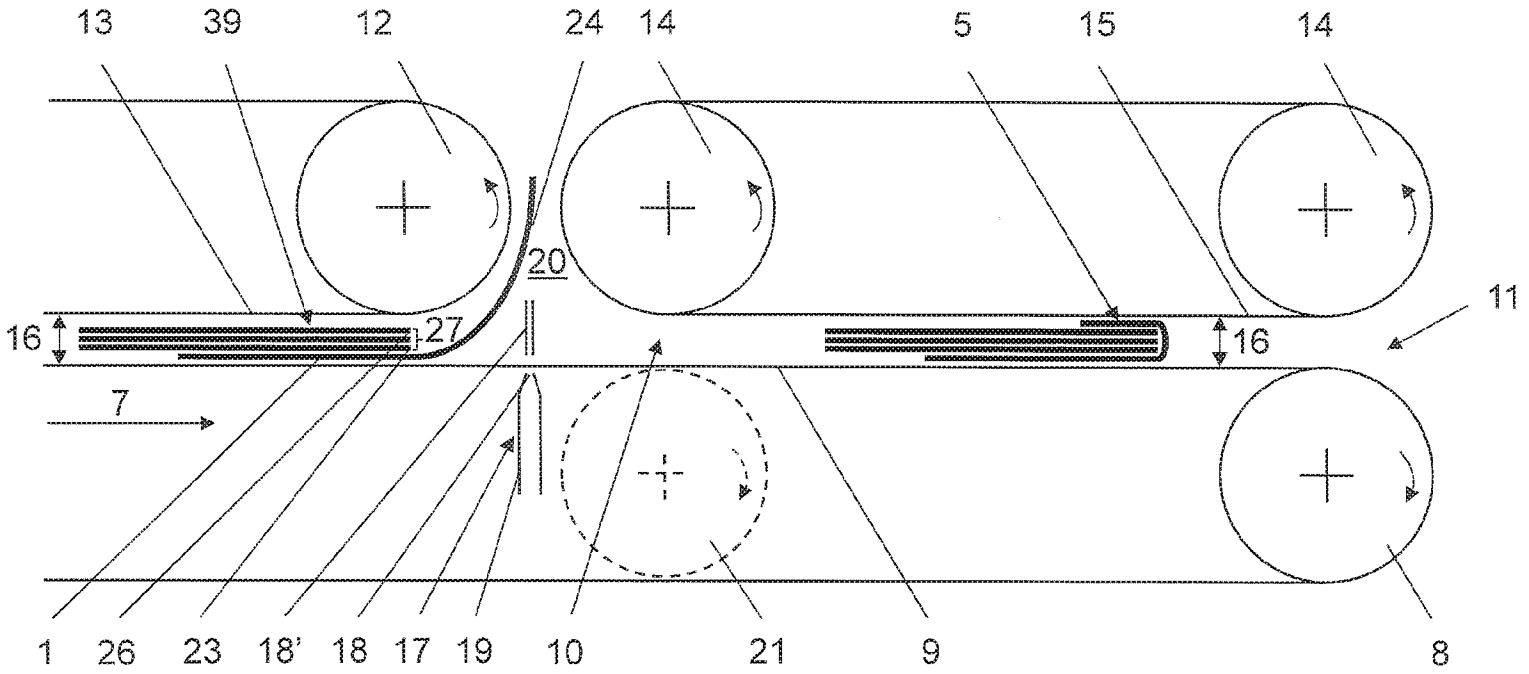
FIG. 2 shows an enlarged representation of a region downstream of the gathering section shown in FIG. 1, with a pneumatic deflection element.

As shown in the enlarged representation in FIG. 2, a second conveying element 13 that circulates around deflection rolls 12 and is embodied as a conveying belt is arranged at a distance above the first conveying element 9, downstream of the gathering section 6, and a third conveying element 15 adjoins the second conveying element 13 in the transporting direction 7, which is also embodied as conveying belt, is arranged at a distance above the first conveying element 9, and circulates around deflection rolls 14. The conveying elements 9, 13, 15 can comprise respectively a single conveying belt or several conveying belts with intermediate spaces. Of course, chains, toothed belts or similar conveying means can also be used for the conveying elements 9, 13, 15.

An essentially identical vertical distance 16 exists between the second conveying element 13 and the first conveying element 9 and/or between the third conveying element 15 and the first conveying element 9, wherein this distance corresponds to the thickness of the advertising media compilation 5 and can be adapted automatically to the thickness of an advertising media compilation 5 that differs from a following production order by correspondingly lowering or raising the first conveying element 9.

The folding device 10, arranged downstream of the gathering section 6, comprises the third conveying element 15, which circulates around the deflection rolls 14 and adjoins the second conveying element 13 in the transporting direction 7, as well as the portion of the first conveying element 9 which is arranged below the third conveying element 15.

A deflection chamber 20 is positioned between the gathering section 6 and the folding device 10, more precisely between the downstream deflection roll 12 of the second conveying element 13 and the upstream-arranged deflection roll 14 of the third conveying element 15, and is therefore arranged above the conveying element 9. A deflection device 17 is arranged in the region of the first conveying element 9 which comprises a pneumatic deflection element in the form of a compressed-air nozzle that is connected to a non-depicted compressed-air source and has at least one discharge opening 18. For triggering the compressed-air jet 18' coming from the at least one discharge opening 18, a magnetic valve can be positioned inside a compressed-air line, not show herein, which is connected to the compressed-air source and the compressed-air nozzle and can be connected to the machine control 29 (see FIG. 1). The at least one discharge opening 18 and thus the compressed-air jet 18' is focused in this case onto the deflection chamber 20, arranged above the deflection device 17. Below the upstream-arranged deflection roll 14 of the third conveying element 15, a pressing roll 21 can also be arranged which cooperates with the deflection roll 14 for compressing the advertising media compilation 5.

The device 11 for transporting away the advertising media compilation 5 is formed by the first conveying element 9 and the third conveying element 15 and/or their downstream arranged deflection rolls 8, 14, respectively. A diverter, not shown herein, for removing incomplete or defective advertising media compilations 5 can be arranged downstream of the transporting away device 11.

During the operation of the apparatus 40, an envelope 1 is first separated out with the aid of a separating out and feeding element A from a stack a of advertising media used as envelopes and is transported along a single guide member A" indicted in FIG. 1 or between two guide members A" (not shown), to the first conveying element 9 where it is deposited in a defined position with at least approximately the same speed as the movement speed of the first conveying element 9.

In a following step, the second separating out and feeding element B is used to separate out a first insert 2 from a stack b of advertising media used as first inserts 2 and is transported along a single guide element indicated in FIG. 1, or between two guide members B" (not shown), to the first conveying element 9 where it is deposited offset, counter to the transporting direction 7, on the envelope 1 already positioned on the conveying element 9 and moving in the transporting direction 7, such that a leading edge 22 of the envelope 1 has a projecting length 24, relative to a leading edge 23 of the first insert 2, as seen in the transporting direction 7. This offset of the envelope 1 and/or the first insert 2 is realized by correspondingly triggering the respective individual drive 30.

In a further step, the third separating out and feeding element C separates out a second insert 3 from a stack c of advertising media used as second inserts 3 and transports it along a single guide member C" indicated in FIG. 1 or between two guide members C" (not shown) to the first conveying element 9 and deposits this insert on the envelope 1, already positioned on the first conveying element 9 and conveyed in the transporting direction 7, as well as on the first insert 2, positioned offset from the envelope, to form an insert stack 39 (FIG. 2). The leading edge 23 of the first insert 2 and a leading edge 25 of the second insert 3 are aligned essentially flush in the transporting direction 7.

In a following step, a third insert 4 is separated out via the fourth separating out and feeding element D from a stack d of advertising media used as third inserts 4 and transported along a single guide member D" indicated in FIG. 1, or between two non-depicted guide members, to the first conveying element 9, is deposited on the envelope already positioned on the first conveying element 9 and transported in transporting direction 7, as well as on the first and second inserts 2, 3 previously positioned offset from the envelope to form an insert stack 39, such that the leading edge 23 of the first insert 2, the leading edge 25 of the second insert 3 and a leading edge 26 of the third insert 4 are aligned essentially flush in the conveying direction 7.

The essentially flush aligned, leading edges 23, 25, 26 of the first, the second and third inserts 2, 3, 4, which are offset relative to the leading edge of the envelope 1, form at least approximately a folding edge 27 around which the projecting length 24 of the envelope 1 is folded in a following operational step in the folding device 10. In the process, the leading projecting length 24 of the envelope 1 is first admitted downstream of the gathering section 6 and is deflected upward with the compressed air jet 18' into the region of the deflection chamber 20 between the downstream deflection roll 12 of the second conveying element 13 and the upstream deflection roll 14 of the third conveying element 15 (FIG. 2). During the further transport in the transporting direction 7 of the envelope 1 and the inserts 2, 3, 4, deposited offset thereon, the folding edge 27 of the inserts 2, 3, 4 which is formed by the leading edges 23, 25, 26 is pressed against the lower region of the projecting length 24 of the envelope 1 which is deflected upward, so that the projecting length 24 is then folded around this joint folding edge 27, as well as in part around the insert stack 39, because of the effect of the deflection roll 14 of the third conveying element 15. The advertising media compilation 5, formed in this way with the envelope 1 and thereon positioned inserts 2, 3, 4, is conveyed further in the transporting direction 7 between the first conveying element 9 and the third conveying element 15, is further folded along the folding edge 27 in the process, and is finally discharged in the region of the device 11 for the further processing.

The further processing can involve, for example, covering the individual advertising media compilations 5 with foil, or forming a joint stack of several advertising media compilations 5 with or without subsequent foil covering, but can also involve simply the transport to an intermediate storage area. For this, the advertising media compilation 5 can initially be provided, via an inkjet printer, with machine-readable and/or person readable information, for example information relating to the further processing, the delivery, or the recipient and can furthermore be personalized or regionalized. In addition, the advertising media compilation 5 can also be electrostatically blocked to prevent a displacement of the inserts 2, 3, 4 during a subsequent processing step.

Figure 3:
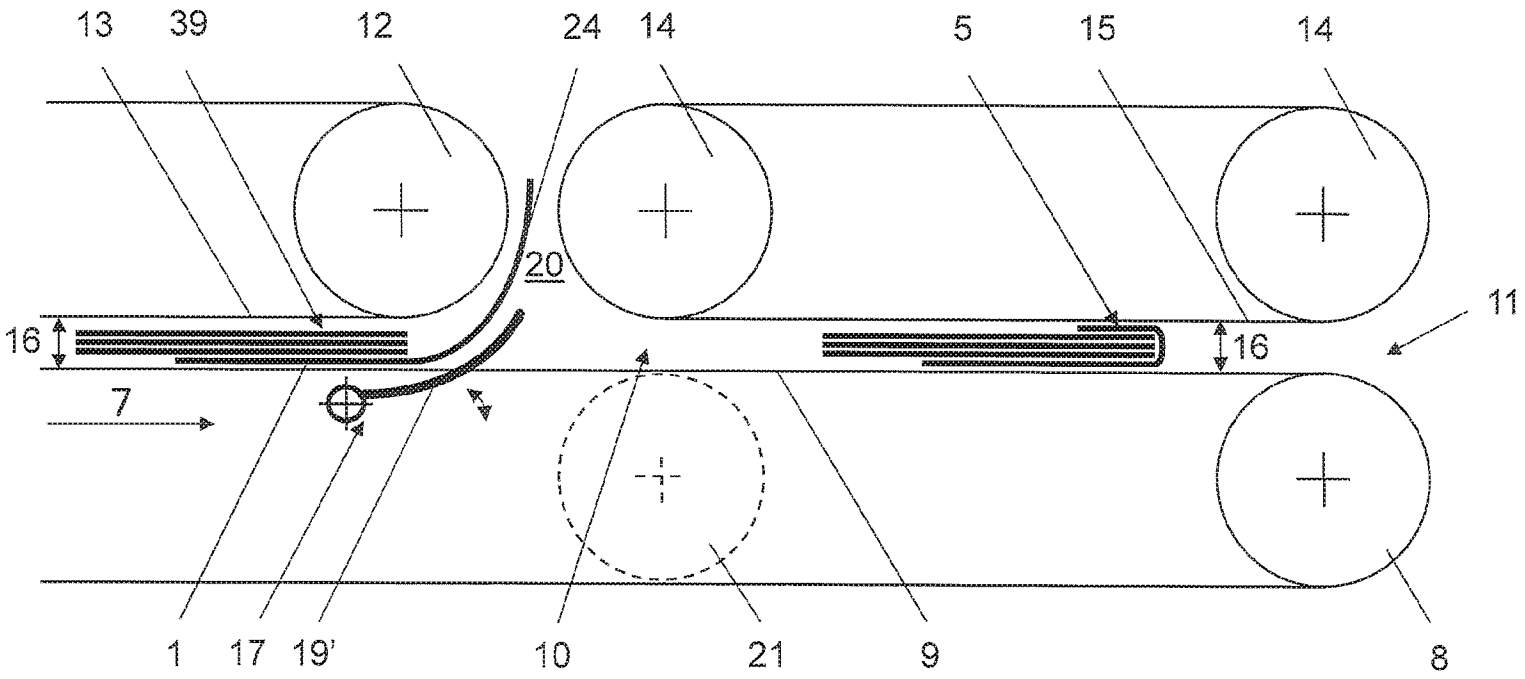
FIG. 3 shows a representation similar to FIG. 2, but with a mechanical deflection element.

FIG. 3 shows an alternative for deflecting the projecting length 24 of the envelope 1 into the deflection chamber 20. Instead of the pneumatic deflection element 19 according to FIG. 2, which releases a compressed air jet 18', the deflection device 17 in this case can be a mechanical deflection element 19' in the form of a bent metal sheet and can be swiveled or moved as needed into the conveying path of the envelope 1 on the first conveying element 9.

Of course, the gathering section 6 is not restricted to the previously described number of advertising media separated out by a separating out and feeding element A for use as an envelope 1 and three separating out and feeding elements B, C, D for the inserts 2, 3, 4, but can have an optional number of separating out and feeding elements A, B, C, D for the advertising media used as envelope and inserts, depending on the order spectrum of the producer of advertising media compilations 5. The same advertising media can additionally be used either for the envelope 1 or for the inserts 2, 3, 4, depending on the advertising media compilation to be produced.

Figure 4:
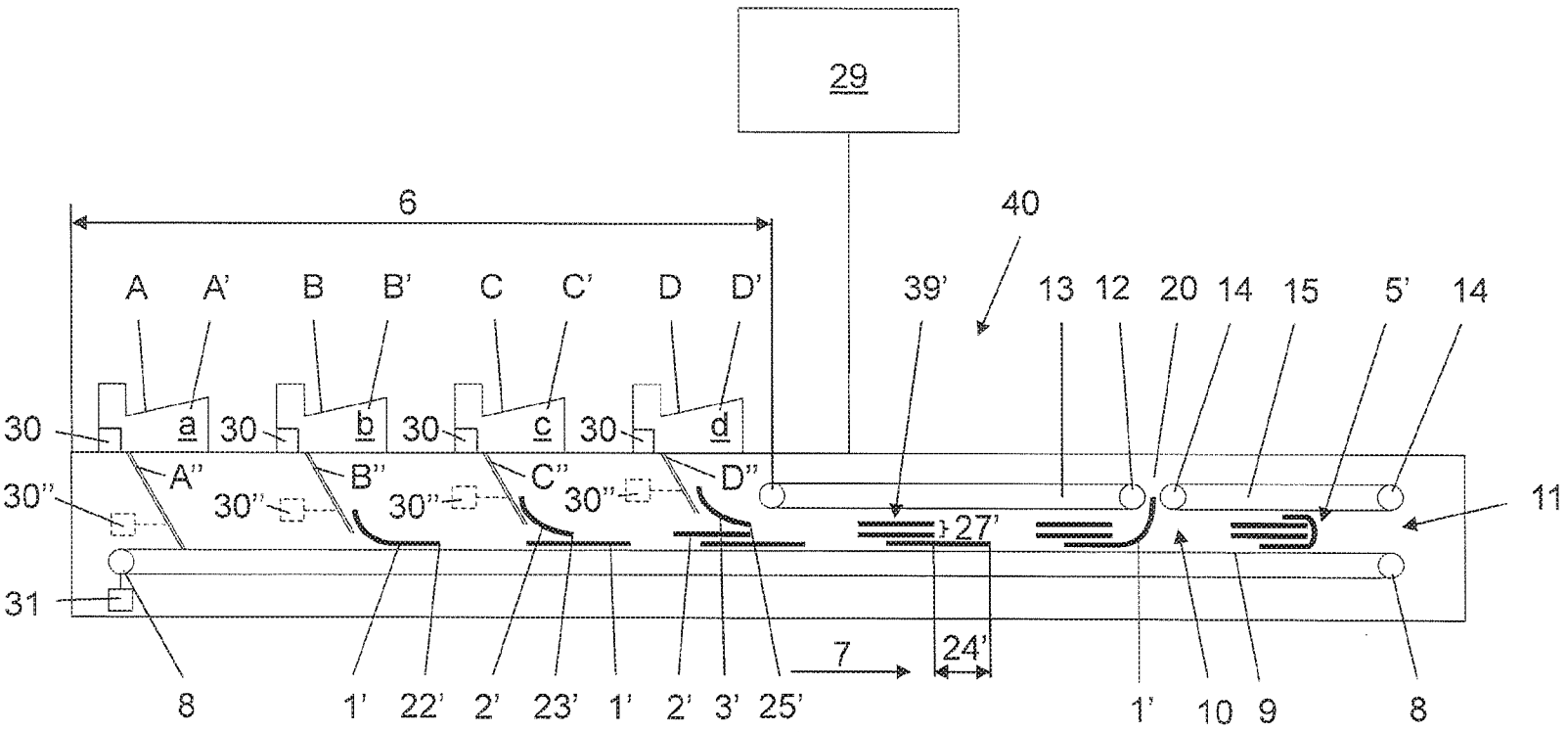
FIG. 4 shows a representation according to FIG. 1, wherein an advertising medium used as additional envelope, however, is separated out from a different stack.

FIG. 4 shows how different advertising media compilations 5' can be produced successively with the apparatus 40 as compared with the advertising media compilations 5 shown in FIG. 1. In the process, the advertising media compilation 5', using an envelope 1', which differs from a first envelope 1, and the associated inserts 2', 3', is essentially produced in the same way as the previous advertising media compilation 5. Since each stack a, b, c, d contains respectively the same advertising media, but the different stacks a, b, c, d among themselves contain different advertising media, which are additionally used either for the envelope 1, 1' or the inserts 2, 3, 4, 2', 3', depending on the advertising media compilation 5, 5' to be formed, the respective operational sequence differs in detail.

For example, if a first advertising media compilation 5 was initially formed according to FIG. 1, then a following advertising media compilation 5' can be produced according to FIG. 4 by not operating the first separating out and feeding element A and, instead, using the second separating out and feeding element B the in transporting direction 7 to supply an advertising medium used as envelope 1' that differs from the envelope 1 and using the separating out and feeding elements C, D to supply advertising media which are used for the inserts 2', 3'. Because in FIG. 4, only two inserts 2', 3' are combined to form an insert stack 39' and the advertising media compilation 5' to be formed has a folding edge 27' that is composed only of the leading edges 23', 25' of the inserts 2', 3', and is thus thinner than the previously formed advertising media compilation 5, a smaller projecting length 24' has proven sufficient. In addition to the thickness of the advertising media 5, 5' to be formed, the necessary projecting length 24, 24' also depends on the format and the material of the advertising media used for the envelope or inserts.

To produce different advertising media compilations 5, 5' with the above-described apparatus 40, each advertising medium suitable for use as envelope 1, 1' is first recorded in the computer-aided machine control 29. Not suitable for use as an envelope, for example, is an advertising medium composed of a thick or otherwise hard to fold material or which is located in the transporting direction 7 in the last stack d of the apparatus 40. For each recorded advertising medium, an offset value is then defined that corresponds to the required projecting length 24, 24', relative to the associated inserts 2, 3, 4, 2', 3'. This offset value is used to compute the required projecting length 24, 24' for the changeover from one advertising media compilation 5 to a following advertising media compilation 5' to be produced, which uses an envelope 1' that differs from the envelope 1.

The individual drive units 30 of the separating out and feeding elements A, B, C, D and/or the individual drive unit 31 of the first conveying element 9 are actuated with the respective offset value recorded in the computer-aided machine control 29. The projecting length 24' of a leading edge 22' of a different envelope 1', relative to the leading edges 23', 25' of the associated inserts 2', 3', can thus be formed during the separating out from the stack b of the advertising medium used as envelope 1', or during the separating out of the associated inserts 2', 3' from the stacks c, d. Alternatively, or also in connection therewith, the projecting length 24' can also be formed via the guide members B", C", D", meaning during the transport of the additional envelope 1' or the associated inserts 2', 3' to the conveying element 9 or also during the transport on the conveying element 9.

The projecting length 24' of the additional envelope 1' can thus be formed through acceleration, as compared to the first envelope 1, or an earlier movement of the additional envelope 1' during the separating out from the stack b, or its transport to the conveying element 9, or during the transport on the conveying element 9. As an alternative, the projecting length 24' of the additional envelope 1' can also be formed with a delay as compared to the inserts 3, 4 of the first advertising medium 5, or a later movement of the additional inserts 2', 3' of the envelope 1' during the separating out from the respective stack c, d, or the transport to the conveying element 9, or during the transport on the conveying element 9.

Even though FIG. 4 shows that the first separating out and feeding element A, for example, is not operational and that the second separating out and feeding element B in the transporting direction 7 supplies an advertising media used as envelope 1', an optional downstream arranged separating out and feeding element can also be used for feeding an envelope when using an apparatus 40 composed of more than the illustrated four separating out and feeding elements A, B, C, D. In general, the respectively first separating out and feeding element that feeds the conveying element 9 supplies an advertising medium used as envelope 1, 1' and the separating out and feeding elements arranged further downstream supply advertising media used as inserts to the conveying element 9.

Since the deflection means 17 and the folding device 10 are connected to the machine control 29, a decision can be made selectively and based on the production order whether to use the previously described joining of an envelope 1, 1' with several inserts 2, 2', 3, 3', 4 to form an advertising media compilation 5, 5', or whether to pass through the folding device 10 without a folding operation. In the process, an insert 2, 2', 3, 3' 4 that is not combined with an envelope 1, 1' to form an advertising media compilation 5, 5' can be positioned during the further processing below or above an advertising media compilation 5, 5' and can be delivered jointly therewith to the client. Of course, very different combinations of advertising media compilations 5, 5' and additional inserts 2, 3, 4 can be generated in this way.

Figure 5:
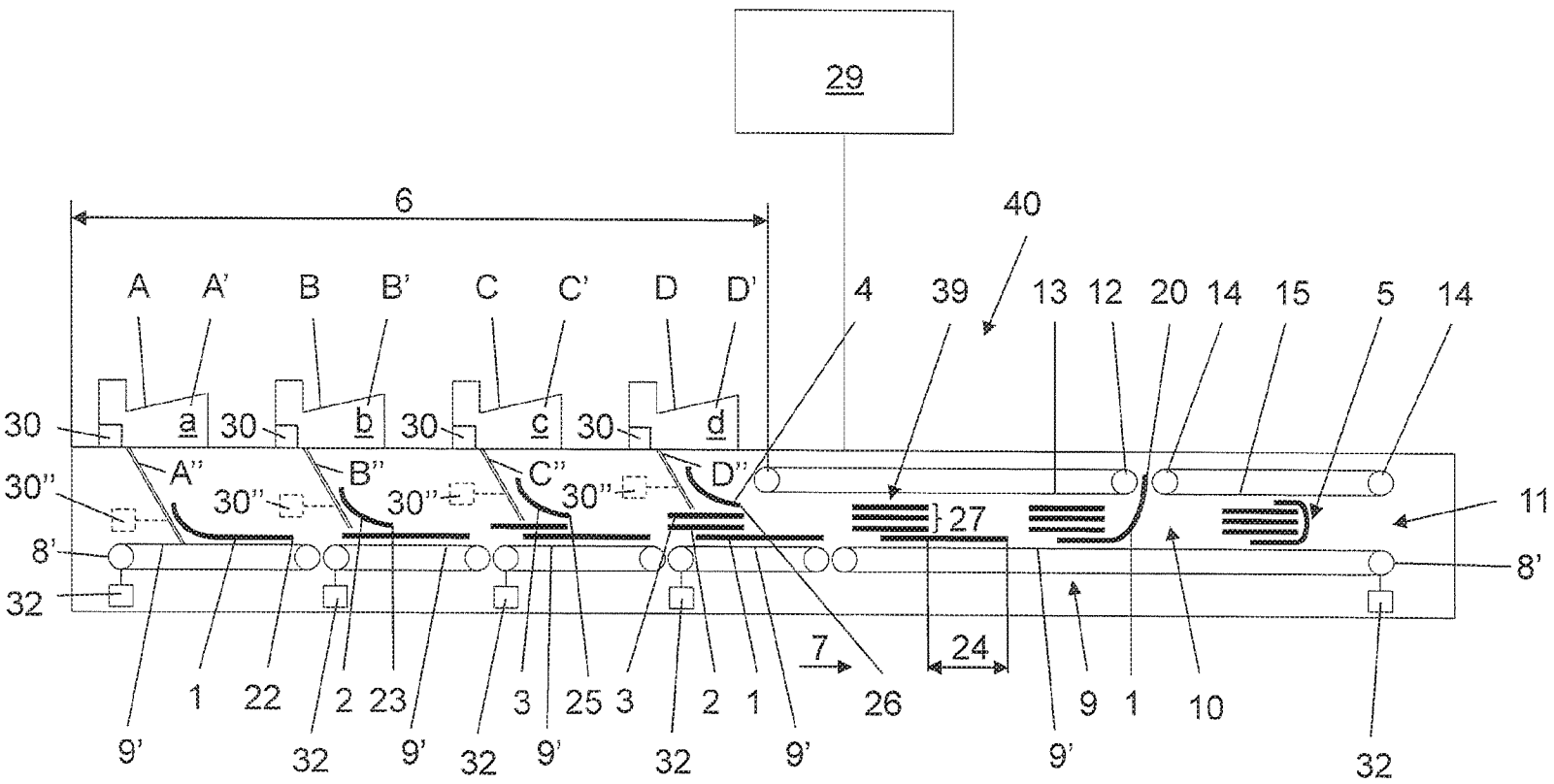
FIG. 5 shows a representation according to FIG. 1, but in a variant with a segmented first conveying element.

FIG. 5 shows a variant of the apparatus 40 for which the conveying element 9 comprises several successively arranged conveying sections 9' and each conveying section 9' is provided with an individual drive unit 32 that is connected to the machine control 29. With this variant, the projecting length 24 can advantageously be formed along the conveying sections 9' of the conveying element 9, so that it is not necessary to form the projecting length 24 during the separating out with the separating out and feeding element A, B, C, D or during the conveying with the guide member A", B", D".

Alternative to using a separating out and feeding element A, B for an envelope 1, 1', and/or to using one or several separating out and feeding elements B, C, D for supplying inserts 2, 3, 4, 2, 3', the gathering section 6 can also be connected directly with one or a plurality printing presses, in particular digital printing presses, and can be supplied by the one or plurality of digital printing presses with the envelope 1, 1' and/or with inserts 2, 3, 4, 2', 3'.

Even though the respective envelope 1, 1' and the associated inserts 2, 3, 4, 2', 3' are shown for drawing reasons spaced apart in the figures, they are actually positioned in contact with and one above the other. In the same way, the spacing between the respective envelope 1, 1' and the associated inserts 2, 3, 4, 2', 3', relative to the respective conveying means, is only for drawing reasons, meaning the partial products/products are actually in contact with the conveying means for the conveying.

FIGS. 7 to 11 schematically illustrate the operating steps for producing an advertising media compilation 5 with an apparatus 40 that corresponds to the exemplary embodiment shown in FIG. 1.

Figure 7:
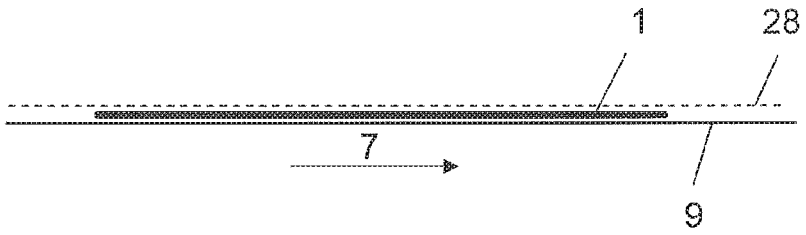
FIG. 7 shows a schematic representation of the envelope deposited on a conveying element and conveyed in transporting direction, according to the first exemplary embodiment of FIG. 1.

According to FIG. 7, the advertising medium withdrawn by the separating out and feeding element A, not shown herein, and deposited on the first conveying element 9 as envelope 1 for the advertising media compilation 5 to be formed is conveyed in conveying direction 7. An additional conveying element 28 is optionally arranged above the envelope 1 to effectively prevent the envelope 1 from being displaced on the first conveying element 9. The additional conveying element 28 and the second conveying element 13 can be combined into a single conveying element.

Figure 8:
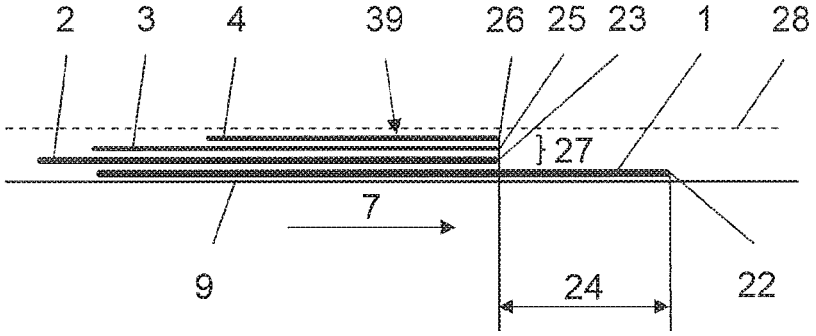
FIG. 8 shows a representation according to FIG. 7, but with three inserts, deposited offset on the envelope, counter to the transporting direction.

FIG. 8 shows the advertising media used as inserts 2, 3, 4, which are deposited offset by the non-depicted separating out and feeding elements B, C, D onto the envelope 1 that is conveyed on the first conveying element 9 in transporting direction 7. In addition, the projecting length 24 of the leading edge 22 of the envelope 1 is clearly visible, relative to the leading edges 23, 25, 26 of the inserts 2, 3, 4.

Figure 9:
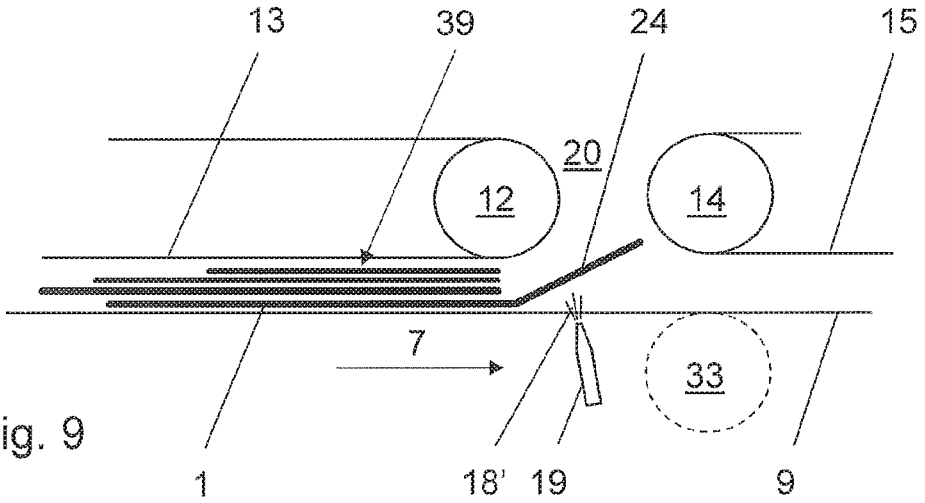
FIG. 9 shows a representation according to FIG. 8, showing the deflection upward of the projecting length on the envelope, relative to the inserts.

FIG. 9 illustrates how the compressed air jet 18' exiting the discharge opening 18 of the pneumatic deflection element 19 deflects the projecting length 24 of the envelope 1 upward and into the deflection chamber 20, between the downstream deflection roll 12 of the second conveying element 13 and the upstream deflection roll 14 of the third conveying element 15.

Figure 10:
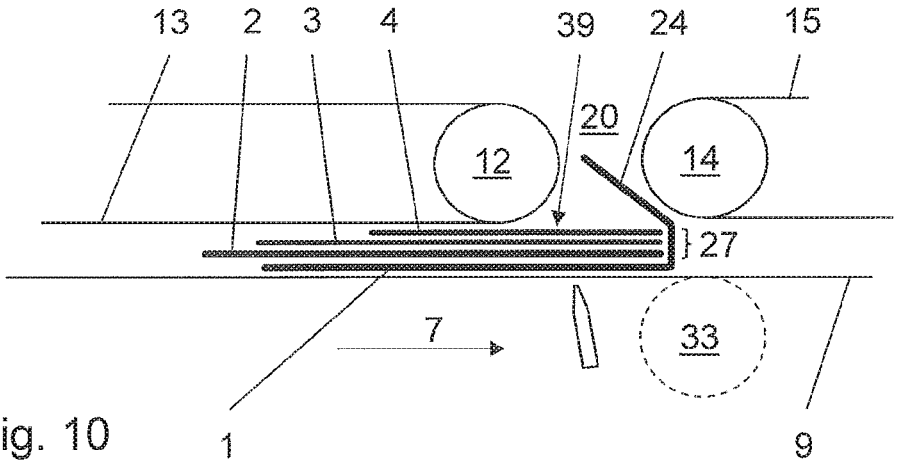
FIG. 10 shows a representation according to FIG. 9, for which the deflected projecting length of the envelope is turned over even more with the aid of folding rolls.

FIG. 10 shows how the projecting length 24 of the envelope 1, conveyed further in transporting direction 7, is folded over via the upstream-arranged deflection roll 14 of the third conveying element 15, but only around the folding edge 27 of the inserts 2, 3, 4 that are positioned offset on the envelope 1, as well as partially around the insert stack 39.

Figure 11:
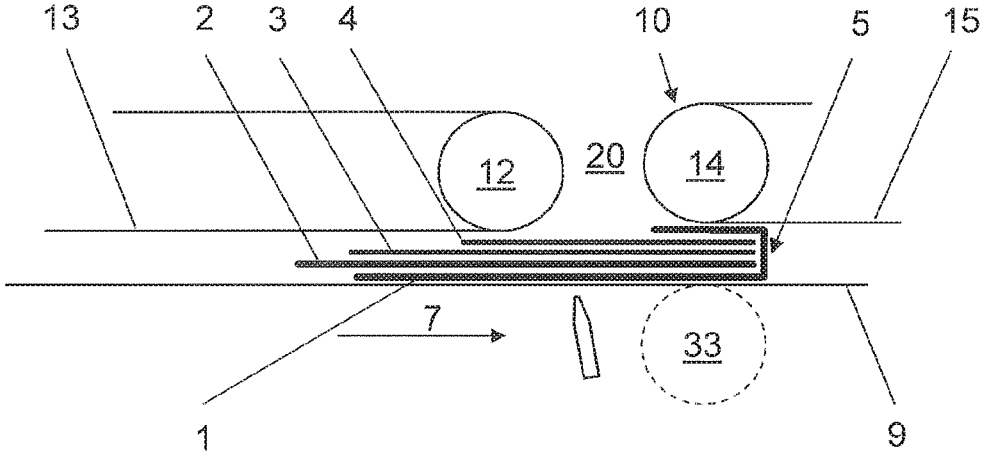
FIG. 11 shows a representation according to FIG. 10, for which the folding rolls have folded the projecting length of the envelope around the inserts and thus have formed an advertising media compilation.

According to FIG. 11, the envelope 1 and the thereon positioned inserts 2, 3, 4 are conveyed further in transporting direction 7, so that the earlier projecting length 24 of the envelope 1 is folded in the folding device 10 between the first conveying element 9 and the third conveying element 15, thus forming the advertising media compilation 5 which consists of the envelope 1 and the inserts 2, 3, 4. A folding roll 33 can also be arranged below the upstream deflection roll 14 of the third conveying element 15 which is embodied as a folding roll, wherein this folding cooperates with the deflection roll for the full surface folding of the advertising media compilation 5. Alternatively, two folding rolls arranged downstream of the folding device 10 are conceivable as well.

Figure 6:
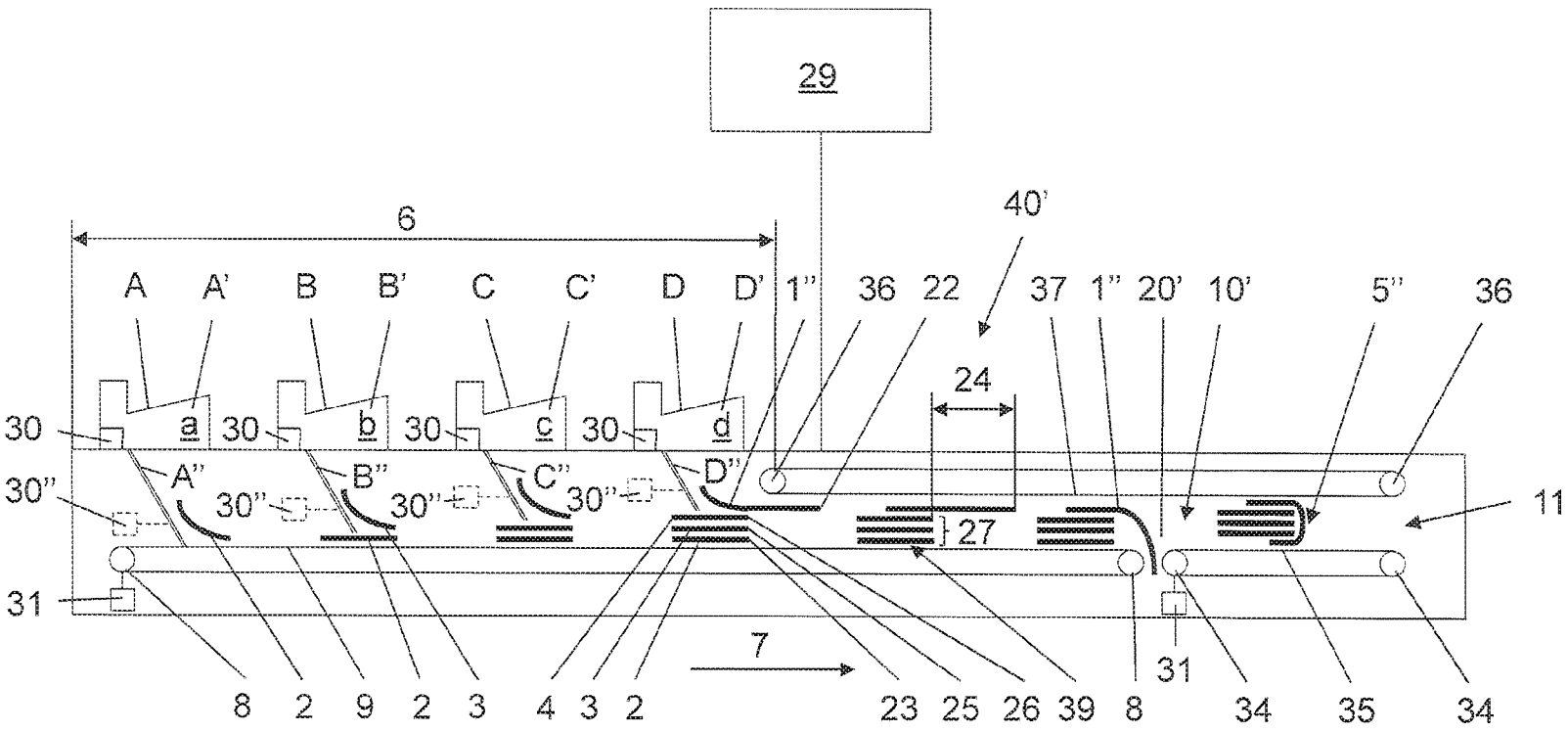
FIG. 6 shows a side view apparatus according to a second exemplary embodiment of the invention.

FIG. 6 shows a second exemplary embodiment of an apparatus 40' where an advertising medium used as envelope 1' is withdrawn only with the last separating out and feeding element D of the gathering section 6 from the stack d, in contrast to the first exemplary embodiment shown in FIGS. 1 to 5 and 7 to 11, and is deposited on the insert stack 39, formed previously with advertising media used as inserts 2, 3, 4 and transported on the first conveying element 9, such that the leading edge 22 of the envelope 1" in transporting direction 7 is arranged offset to the edges 23, 25, 26 of the inserts 2, 3, 4 that form the folding edge 27 and thus form a projecting length 24. The first conveying element 9 which is also guided around deflection rolls 8 ends downstream of the gathering section 6. Downstream of the first conveying element 9 and at a distance thereto, a further conveying element 35 is arranged which moves around deflection rolls 34 and is embodied as a conveying belt. A deflection chamber 20' is located between the downstream deflection roll 8 of the first conveying element 9 and the third upstream deflection roll 34 of the conveying element 35. Above the two conveying elements 9, 35 and at a distance thereto, another conveying element 37 is arranged which overlaps the two conveying elements 9, 35, circulates around deflection rolls 36 and is also embodied as a conveying belt. The conveying element 35 and the conveying element 37 jointly form a folding device 10'.

Figure 12:
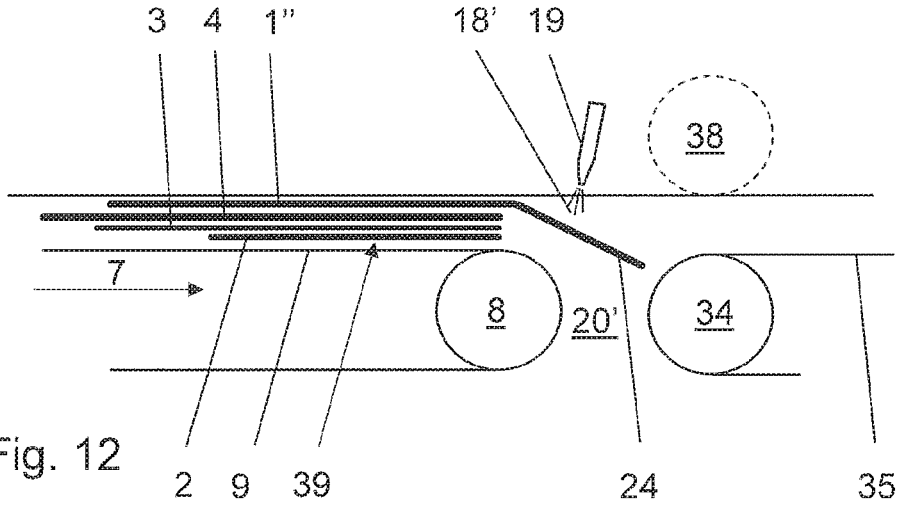
FIG. 12 shows a step of deflecting the offset on the envelope, relative to the inserts for producing an advertising media compilation, similar to FIG. 10, but with the deflection in downward direction corresponding to the embodiment shown in FIG. 6.

Analogous to FIG. 9 showing the first exemplary embodiment, FIG. 12 shows the second embodiment for which the projecting length 24 of the envelope 1" is deflected downward into the deflection chamber 20' via the compressed air jet 18' from the discharge opening 18 in the pneumatic deflection element 19, between the downstream deflection roll 8 of the first conveying element 9 and the upstream deflection roll 34 of the conveying element 35.

As shown in FIG. 6, the envelope 1" and thereon positioned inserts 2, 3, 4 are then conveyed further in transporting direction 7, so that the projecting length 24 of the envelope 1" that is folded over the folding edge 27. Thus, the advertising media compilation 5", composed of the envelope 1" and the inserts 2, 3, 4, is folded in the folding device 10', meaning between the conveying element 35 and the conveying element 37. Referring again to FIG. 12, a folding roll 38 can optionally be arranged above the deflection roll 34, additionally embodied as folding roll and positioned upstream of the conveying element 35, which cooperates therewith for the folding of the advertising media compilation 5". Two folding rolls arranged downstream of the folding device 10' are alternatively also conceivable.

Figure 13:
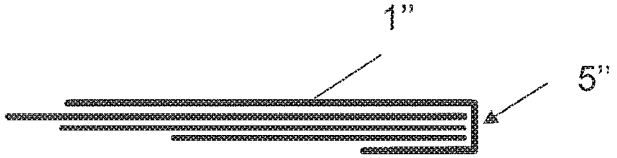
FIG. 13 shows an advertising media compilation formed according to the second exemplary embodiment, shown in FIGS. 6 and 12.

FIG. 13 shows an advertising media compilation 5", formed with the apparatus 40 according to the second exemplary embodiment, which differs optically from the advertising media compilations 5 produced with an apparatus 40 according to the first exemplary embodiment, but only with respect to the positioning of the envelope 1" that is folded around the inserts 2, 3, 4. The advertising media compilations 5, 5" can essentially be processed further in the same way.

It will be understood that the above description of the present invention is susceptible to various modifications, changes and adaptations, and that the same are intended to be comprehended within the meaning and range of equivalents of the appended claims.

What is claimed is:

1. A method for forming advertising media compilations with respectively one envelope and a plurality of inserts constituting advertising media, comprising:

depositing a first set of selected ones of plurality of inserts individually and successively, one above the other, in a region of a gathering section onto a conveying element moving in a conveying direction, to form a first stack in which leading edges of the inserts are flush aligned to present a joint folding edge;

depositing a first envelope onto the conveying element with a leading edge of the first envelope in the conveying direction offset to the joint folding edge of the inserts associated with the first envelope to form a first projecting length of the first envelope relative to the joint folding edge of the inserts, wherein the first projecting length is a function of at least a first thickness of the first stack;

folding the projecting length of the first envelope along the joint folding edge of the inserts of the first stack and subsequently folding the projecting length around the joint folding edge and at least partially around the first stack to form a first advertising media compilation;

transporting the first media compilation away for further processing;

subsequently forming a second advertising media compilation with a second envelope and a second stack of a different set of selected ones of the plurality of inserts associated with the second envelope, wherein the second envelope has a second projecting length that is function of at least a second thickness of the second stack which differs from the first thickness of the first stack thereby producing a second projecting length that is different from the first projecting length and wherein the second advertising media compilation is formed using steps corresponding to the foregoing steps used to form the first advertising media compilation;

recording each envelope used for forming an advertising media compilation in a computer-aided machine control, including recording a defined offset value that corresponds to the projecting length relative to the inserts associated with each envelope to form the projecting length for each envelope; and using the recorded offset value associated with the second envelope when changing over from the first advertising media compilation to the subsequent second advertising media compilation to form the second projecting length of the second envelope.

2. The method according to claim 1, further comprising: prior to being deposited on the conveying element, respectively separating out the envelopes and the inserts from respective stacks of advertising media and subsequently transporting the envelopes and the inserts to the conveying element.

3. The method according to claim 2, further comprising forming the projecting length of the leading edge of the second envelope relative to the leading edges of the associated inserts by accelerating the second envelope relative to the first envelope or by earlier moving the second envelope during the separating out of the second envelope from the respective stack of advertising material or during the transport to the conveying element, or during the transport of the second envelope while the second envelope is positioned on the conveying element.

4. The method according to claim 2, further comprising forming the projecting length of the leading edge of the second envelope relative to the leading edges of the inserts associated with the second envelope through a speed delay of the second envelope relative to the first envelope, or through a later movement of the inserts belonging to the second envelope during the separating out from the stack, or during the transport to the conveying element, or during the transport on the conveying element.

5. The method according to claim 1, further comprising forming the projecting length of the leading edge of each envelope relative to the leading edges of the associated inserts during a separating out from a stack of the respective envelopes or a separating out from stacks of the associated inserts.

6. The method according to claim 1, further comprising forming the projecting length of the leading edge of each envelope relative to the leading edges of the associated inserts during the transport of the respective envelope or the associated inserts to the conveying element.

7. The method according to claim 1, further comprising forming the projecting length of the leading edge of each envelope relative to the leading edges of the associated inserts during the transport of the respective envelope or the associated inserts while positioned on the conveying element.

8. The method according to claim 1, further comprising transporting the projecting length of the leading edge of each envelope via the conveying element into a region of a deflection chamber; deflecting the projecting length with a pneumatic or mechanical deflection element in the region of the deflection chamber to deflect the projecting length into the deflection chamber; and during a further transport of each envelope in the conveying direction, folding over the projecting length only along the folding edge of the insert stack counter to the conveying direction such that the projecting length is pressed against the insert stack.

9. The method according to claim 1, further comprising depositing the envelopes on the conveying element before depositing the inserts associated with a respective one of the envelopes on the conveying element.

10. The method according to claim 1, further comprising depositing the envelopes on the conveying element after depositing the inserts associated with a respective one of the envelopes on the conveying element.

11. The method according to claim 1, wherein each projecting length is additionally a function of a format and a material of the advertising media used for the envelope or inserts.

* * * * *